US011742161B2

(12) United States Patent
Caro et al.

(10) Patent No.: US 11,742,161 B2
(45) Date of Patent: Aug. 29, 2023

(54) ROTARY DIAPHRAGM IN VACUUM INTERRUPTER SWITCH

(71) Applicant: S&C Electric Company, Chicago, IL (US)

(72) Inventors: Leo Caro, Chicago, IL (US); Michael R. Maroney, Chicago, IL (US); Thomas J. Dyer, Minneola, FL (US); Nicholas Seng, Chicago, IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 17/853,971

(22) Filed: Jun. 30, 2022

(65) Prior Publication Data

US 2023/0012203 A1 Jan. 12, 2023

Related U.S. Application Data

(60) Provisional application No. 63/220,287, filed on Jul. 9, 2021.

(51) Int. Cl.
*H01H 33/666* (2006.01)
*H01H 33/662* (2006.01)

(52) U.S. Cl.
CPC ..... *H01H 33/666* (2013.01); *H01H 33/662* (2013.01)

(58) Field of Classification Search
CPC ..... H01H 33/666; H01H 33/662; H01H 33/66207; H01H 2033/426; H01H 2033/6667
USPC ..... 218/139, 118, 120, 123, 134, 135
See application file for complete search history.

(56) References Cited

U.S. PATENT DOCUMENTS 4,105,878 A 8/1978 Date et al.
4,150,270 A * 4/1979 Zunick ..... H01H 33/66 218/138
4,492,835 A * 1/1985 Turner ..... H01H 33/6661 218/7

(Continued)

FOREIGN PATENT DOCUMENTS

WO 20109206808 A1 10/2019

OTHER PUBLICATIONS

International Search Report and Written Opinion for International Application No. PCT/US2022/35862 dated Nov. 21, 2022. (10 pages).

(Continued)

*Primary Examiner* — William A Bolton

(57) ABSTRACT

An insulating rotary diaphragm for a vacuum interrupter (VI) electrical switch. The insulating diaphragm is designed for use in underground or pad-mounted VI switches where an external lever is rotated by a line worker to manually open the switch. A torsional insulating rod is coupled between a switch actuator and the external lever, and the diaphragm maintains constant contact with the insulating rod and an outer housing when the lever and rod are rotated, thus ensuring adequate isolation between the actuator and the lever. The diaphragm deforms torsionally when the lever and rod are rotated. This configuration allows the actuator to be at medium voltage, eliminates the need for a translational insulating rod between the medium voltage switch components and the lever, and thereby reduces the overall length of the VI switch.

21 Claims, 7 Drawing Sheets

(56) References Cited

U.S. PATENT DOCUMENTS

| | | | | |
|---|---|---|---|---|
| 5,912,604 | A * | 6/1999 | Harvey | H01H 33/6662 218/138 |
| 6,687,110 | B2 * | 2/2004 | Murray | H01H 33/6661 361/131 |
| 8,653,398 | B2 * | 2/2014 | Gentsch | H01H 33/66207 218/118 |
| 9,691,574 | B2 * | 6/2017 | Gerovac | H01H 33/66207 |
| 10,262,819 | B2 * | 4/2019 | Nagatake | C22C 27/06 |
| 2005/0082260 | A1 * | 4/2005 | Martin | H01H 33/027 218/118 |
| 2009/0078681 | A1 * | 3/2009 | Marchand | H01H 33/6606 218/140 |
| 2014/0043119 | A1 | 2/2014 | Bullock et al. | |
| 2015/0262768 | A1 * | 9/2015 | Siebens | H01H 9/16 200/50.32 |
| 2016/0379787 | A1 | 12/2016 | Ashtekar et al. | |
| 2020/0335293 | A1 * | 10/2020 | Goldman | H01H 33/666 |

OTHER PUBLICATIONS

Elastmold Underground Distribution Switchgear catalogue; Thomas & Betts Corporation (24 pages).

* cited by examiner

ROTARY DIAPHRAGM IN VACUUM INTERRUPTER SWITCH

CROSS-REFERENCE TO RELATED APPLICATION

This application claims the benefit of priority from the U.S. Provisional Application No. 63/220,287, filed on Jul. 9, 2021, the disclosure of which is hereby expressly incorporated herein by reference for all purposes.

BACKGROUND

Field

The present disclosure relates generally to an insulating rotary diaphragm for a vacuum interrupter (VI) electrical switch. More particularly, it relates to an insulating diaphragm designed for use in VI switches where a lever is rotated by a line worker to manually open the switch.

Discussion of the Related Art

Vacuum interrupter (VI) switches are a type of electrical switch that are often used to provide fault interruption and service restoration capability between medium voltage lateral lines and distribution transformers in an electrical distribution network. When a fault occurs, the VI switch opens its contacts to stop the flow of fault current. The VI switch also typically recloses the contacts after a brief time period, and stays closed in order to restore power to customers if the fault has self-cleared.

VI switches are used in both overhead powerline installations and in underground and ground-level (pad mounted) installations. A common design for a VI switch uses a linear electromagnetic actuator to drive one of the contacts into the open or closed position. Other types of actuators may also be used. In both overhead and underground/ground-level installations, VI switches may be required to have an external lever or handle, mechanically connected to the actuator, that can be pulled or turned by a line worker in order to manually disconnect the switch. To reduce risk to the line worker, the external lever is grounded.

A challenge encountered in the design of a VI switch is isolating the medium voltage switch components (i.e., the contacts, etc.) from the grounded external lever. One known technique for providing this isolation is to include a translational insulating rod between the switch body and the actuator, thus allowing the actuator and therefore also the external lever to be at ground potential. However, particularly in underground and ground-level installations, it is desirable to minimize the overall length of the entire VI switch assembly including the actuator and lever. The translational insulating rod adds undesirable length to the entire switch assembly.

Another known technique for providing isolation between the medium voltage portion of the switch and the external lever is to use insulating gases or fluids in a portion of a housing located between the actuator and the external lever. However, these insulating gases and fluids are expensive, and containing them within the housing without leaks is difficult.

In view of the circumstances described above, there is need for a VI switch assembly having an improved and simplified means of isolating the medium voltage components of the switch from the grounded external lever, while providing for a switch assembly with an overall length that is less than prior art designs.

SUMMARY

The present disclosure describes an insulating rotary diaphragm for a vacuum interrupter (VI) electrical switch. The insulating diaphragm is designed for use in underground or pad-mounted VI switches where an external lever is rotated by a line worker to manually open the switch. A torsional insulating rod is coupled between a switch actuator and the external lever, and the diaphragm maintains constant contact with the insulating rod and an outer housing when the lever and rod are rotated, thus ensuring adequate isolation between the actuator and the lever. The diaphragm deforms torsionally when the lever and rod are rotated. This configuration allows the actuator to be at medium voltage, eliminates the need for a translational insulating rod between the medium voltage switch components and the lever, and thereby reduces the overall length of the VI switch.

Additional features of the present disclosure will become apparent from the following description and appended claims, taken in conjunction with the accompanying drawings.

DETAILED DESCRIPTION OF THE EMBODIMENTS

The following discussion of the embodiments of the disclosure directed to an insulating rotary diaphragm for a vacuum interrupter (VI) electrical switch is merely exemplary and is in no way intended to limit the disclosure or its applications or uses.

An electrical power transmission/distribution network, often referred to as the electrical grid, includes circuit breakers, fuses and switches that open in the event of a fault to cut off potentially damaging fault currents. In the distribution portion of the grid, feeders and laterals provide power at medium voltage to residential and other end-use customers, where a distribution transformer performs the final transformation from medium voltage down to consumer voltages of 120/240 VAC. A switch with reclosing capability, often a vacuum interrupter (VI) switch, is typically located between the medium voltage lateral line and the distribution transformer.

Figure 1:
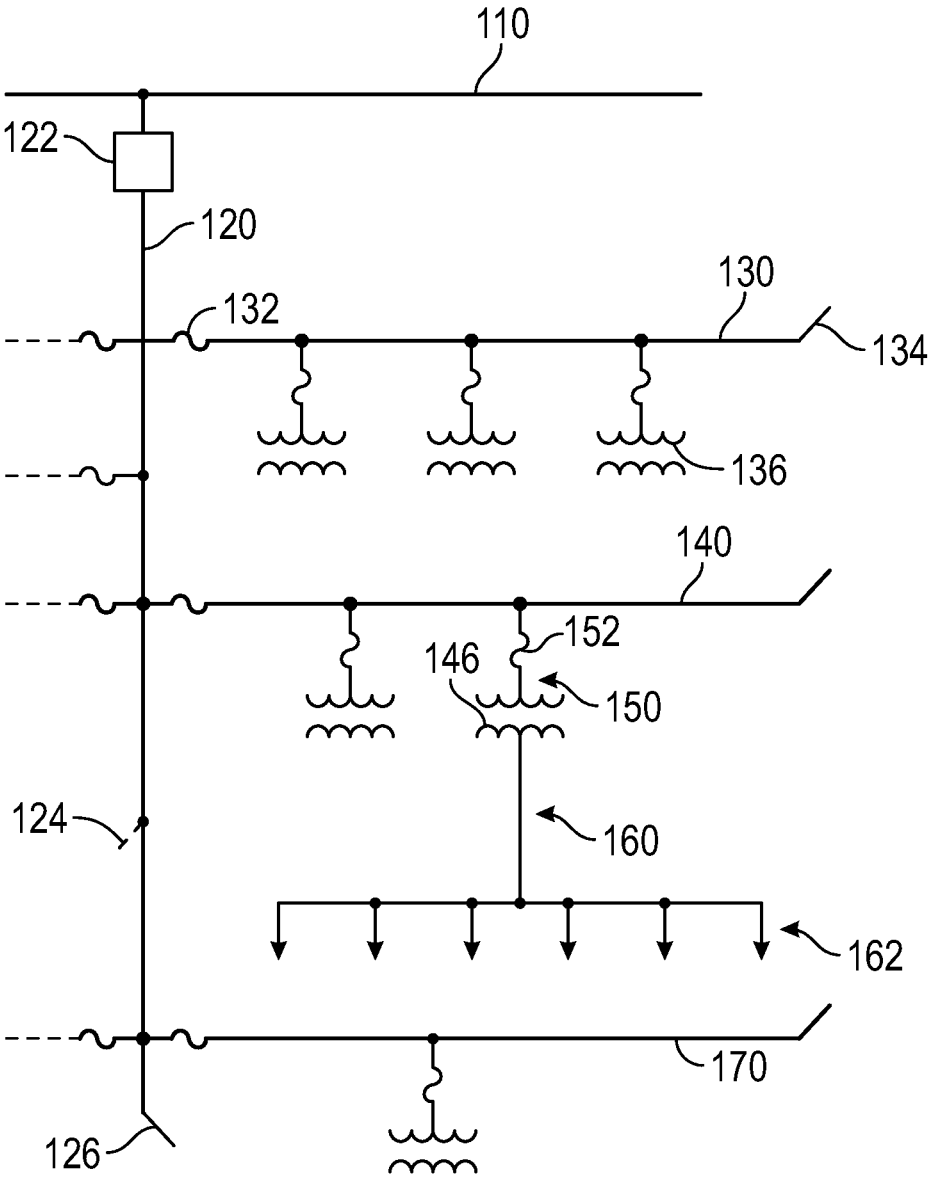
FIG. 1 (Prior Art)
FIG. 1 is a simplified schematic diagram of a portion of a typical distribution grid feeder with laterals, illustrating a location where a vacuum interrupter (VI) switch would typically be used, as known in the art.

FIG. 1 is a simplified schematic diagram of a portion of a typical distribution grid feeder with laterals, illustrating a location where a vacuum interrupter (VI) switch would typically be used, as known in the art. Substations are facilities that transform high-voltage power on the transmission grid down to medium voltage power for the distribution grid. A substation bus 110 provides power to a plurality of feeders. In FIG. 1, only a single feeder 120 is shown for the sake of simplicity. The bus 110 and the feeder 120 are both three phase, as is known in the art. A reclosing circuit breaker 122 is provided proximal the connection of the feeder 120 to the bus 110. The feeder 120 typically includes several sectionalizing switches, such as the sectionalizing switch 124 shown in FIG. 1. A normally open tie switch 126 at the distal end from the substation bus 110 connects the feeder 120 to an adjacent feeder when necessary for power restoration.

The feeder 120 typically provides power to several laterals. In FIG. 1, three laterals are shown—numbered 130, 140 and 170. The lateral 130 includes a fuse 132 proximal the feed point where the lateral 130 connects to the feeder 120, and a normally open emergency switch 134 at the distal end. The laterals 140 and 170 are similarly configured with fuses and switches, where the fuse and emergency switch are not numbered in FIG. 1 to preserve visual clarity. Each of the laterals 130, 140 and 170 also includes a plurality of distribution transformers, such as a transformer 136 on the lateral 130 and a transformer 146 on the lateral 140.

Additional details are shown for the lateral 140 and the distribution transformer 146. The distribution transformer 146 transforms the medium voltage power on the lateral 140 down to the final consumer voltage—such as 120/240 VAC split phase. The distribution transformer 146 has a primary side 150 and a secondary side 160, as known in the art. The secondary side 160, which is at the final consumer voltage, typically serves several loads, e.g. consumer houses as shown at 162. On the primary side 150, a fuse or fault-interrupting switch 152 is provided proximal the connection point to the lateral 140. The switch 152 will trip open should a fault occur anywhere on the primary side 150, in the transformer 146 or on the secondary side 160. A vacuum interrupter is commonly used for the switch 152.

A vacuum interrupter (VI) is a type of switch that uses electrical contacts in a vacuum. When a fault occurs, the VI switch opens its contacts to stop the flow of fault current. The VI switch also typically recloses the contacts after a brief time period, and stays closed in order to restore power to customers if the fault has self-cleared. Power on feeders and laterals is typically provided at a voltage of 15 kVAC or more (peak to peak), and so the contacts of the VI switch are typically at a "medium voltage" potential of at least 7500 volts relative to ground.

Separation of the electrical contacts in a VI switch under a load or fault current results in a metal vapor arc, which is quickly extinguished. Vacuum interrupter switches are more compact compared with switchgear using air or oil as the arc-suppression medium. External to the vacuum volume, VI switches require an actuator to drive one of the contacts into either the open or closed position.

VI switches are used in both overhead powerline installations and in underground and ground-level installations. A common design for a VI switch uses a linear electromagnetic actuator to drive one of the contacts into the open or closed position. Other types of actuators may also be used. VI switches may be required to have an external lever or handle, mechanically connected to the actuator, that can be pulled or turned by a line worker in order to manually disconnect the switch. To reduce risk to the line worker, the external lever is grounded. Because the switch contacts are energized at the medium voltage of the lateral (typically several thousand volts AC or more), a robust means of isolation must be provided between the switch contacts and the external lever.

Some prior art VI switches have used an insulating rod in a translating configuration between the switch contacts and the actuator to provide isolation of the actuator and the external lever from the medium voltage components of the switch. Other known VI switches have the actuator at medium voltage along with the contacts and use a translating insulating rod between the actuator and the external lever. However, in either configuration, this sort of translating insulating rod adds length to the overall VI switch assembly, which is undesirable in certain applications such as underground or ground-level (pad-mounted) applications. Other prior art VI switches have used insulating gases or fluids in a portion of a housing located between the actuator and the external lever. However, these insulating gases and fluids are expensive, and containing them within the housing without leaks is difficult.

The present disclosure describes a rotary diaphragm designed for providing isolation between medium voltage components and a grounded external lever in a VI switch assembly. The rotary diaphragm overcomes the disadvantages of the previously employed isolation mechanisms discussed above.

Figure 2:
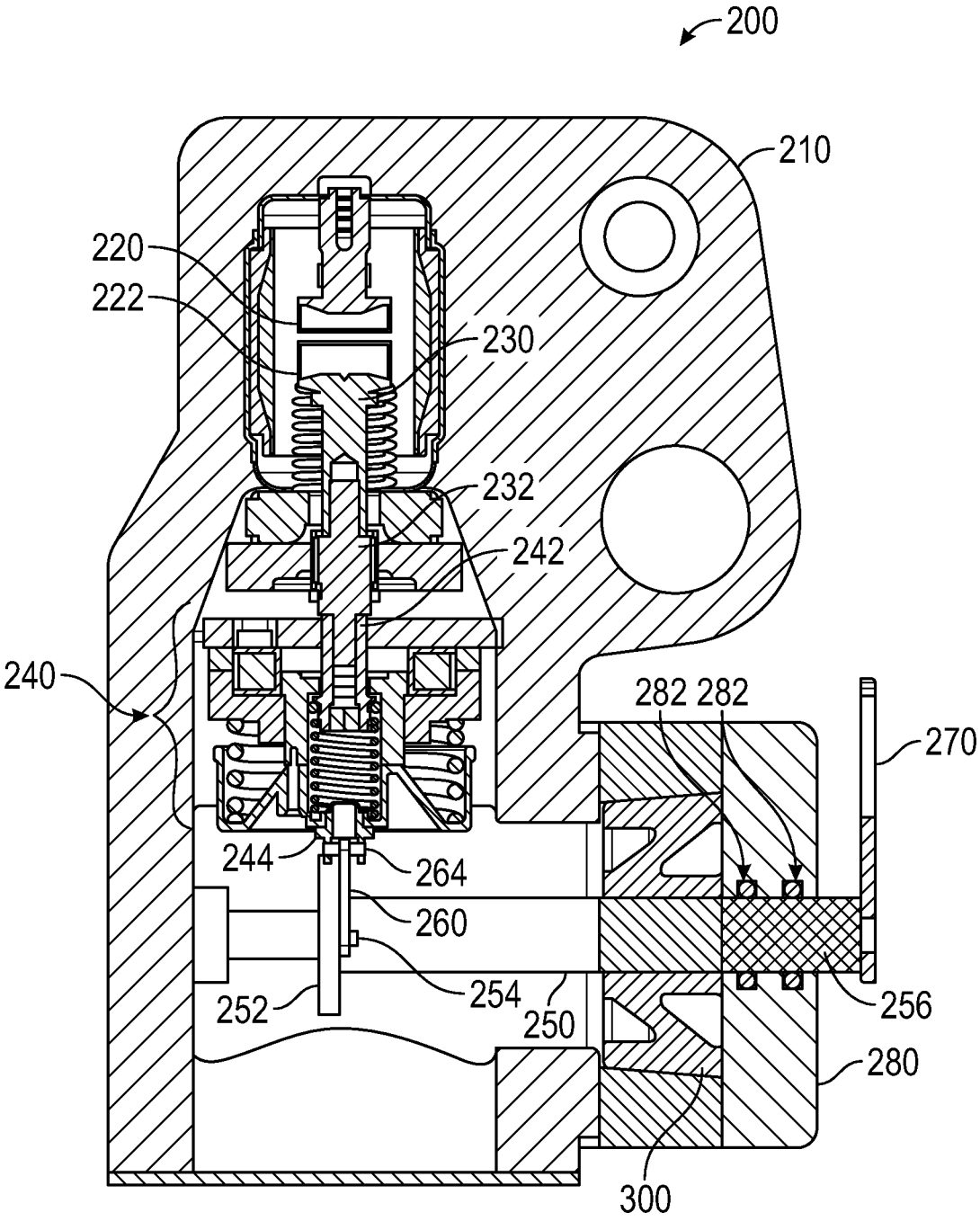
FIG. 2 is a cutaway illustration of a VI switch assembly, showing the configuration of an external lever coupled to an actuator by a rotating insulating rod, and having an insulating rotary diaphragm, according to an embodiment of the present disclosure.
Figure 3:
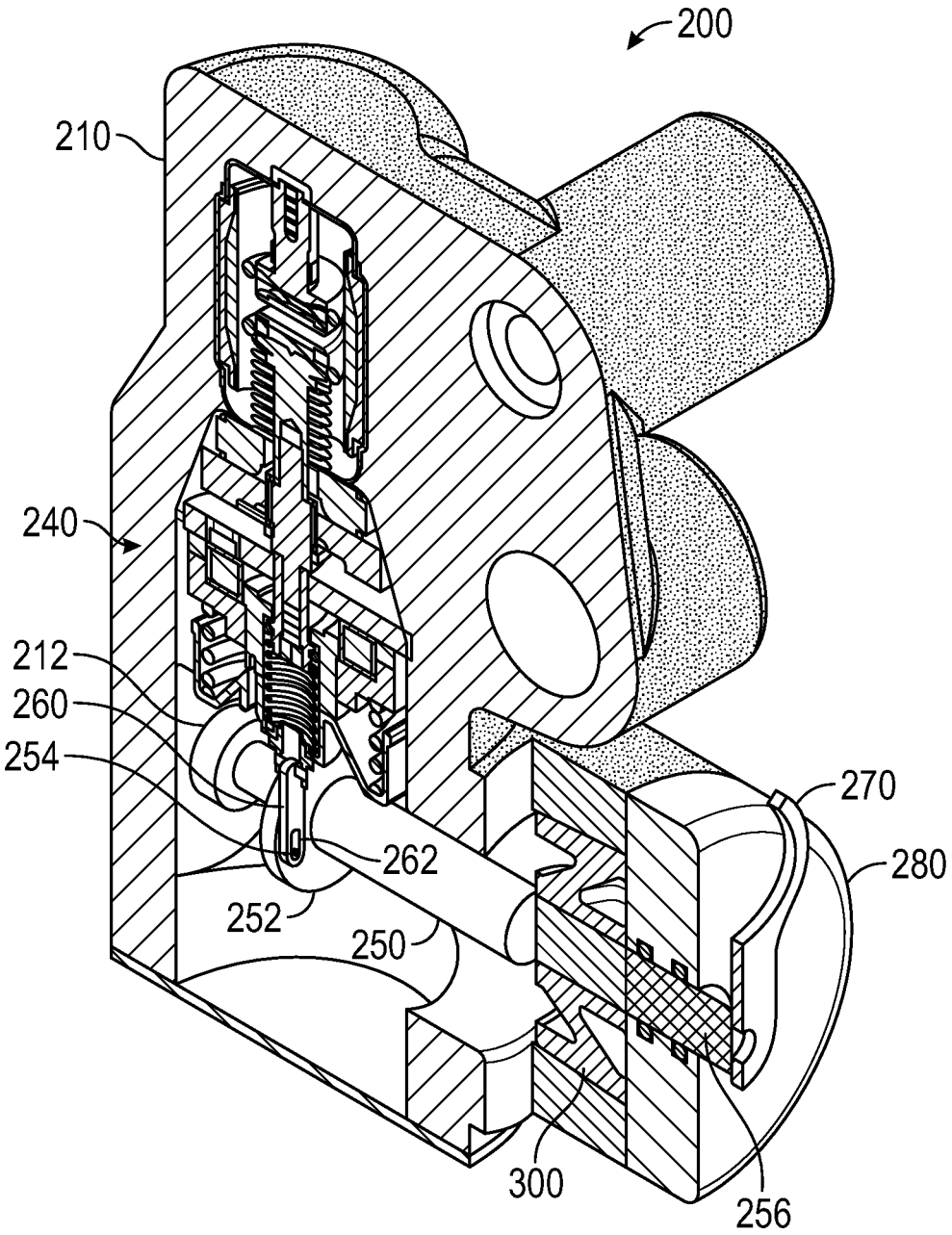
FIG. 3 is a cutaway isometric view illustration of the VI switch assembly of FIG. 2, according to an embodiment of the present disclosure.

FIG. 2 is a cutaway illustration of a VI switch assembly 200, showing the configuration of an external lever coupled to an actuator by a rotating insulating rod, and having an insulating rotary diaphragm, according to an embodiment of the present disclosure. FIG. 3 is a cutaway isometric view illustration of the VI switch assembly 200 of FIG. 2, according to an embodiment of the present disclosure. FIGS. 2 and 3 are both referred to in the following discussion, with many elements being labeled with reference numbers in both of the figures, and some elements being labeled only in whichever figure they are most clearly visible.

A housing 210 serves as an enclosure for all VI switch parts except for a lever that is operable by a line worker, discussed below. The housing 210 is made of a material such as a cycloaliphatic epoxy resin that is easily cast or molded into the desired shape and has good electrical insulation properties. The outer surface of the housing 210 of the switch assembly 200 is coated with a conductive material and is grounded. VI switch contacts 220 and 222 perform the actual electrical switch opening and closing functions. The contacts 220 and 222 are maintained in a vacuum volume to improve arc-suppression performance, as is known in the art. The contact 220 is a fixed contact and is electrically coupled to an input line from the lateral at medium voltage. The contact 222 is a moving contact and is electrically coupled to an output line that typically leads to a distribution transformer, as described with respect to FIG. 1. The contacts 220 and 222 are shown in the open configuration—that is, with the contact 222 pulled down away from the contact 220 by a distance, in one example, of about six millimeters.

The moving contact 222 is mechanically coupled to a stem 230, which is mechanically coupled to a driving rod 232, which in turn is mechanically coupled to an actuator 240. The actuator 240 may be a linear electromagnetic type actuator, or some other type or design of actuator. The purpose of the actuator 240 is to open and reclose the contacts 220/222 of the switch upon command by a controller (not shown) in the VI switch assembly 200. That is, when the controller detects a fault current, the controller commands the actuator 240 to open the switch by pulling the contact 222 downward. When the controller wants to attempt a reclosing, the controller commands the actuator 240 to reclose the switch by pushing the contact 222 upward.

The actuator 240 has an upper coupling 242 that is driven downward to open the switch and driven back upward to reclose the switch. The driving rod 232 is mechanically coupled to the upper coupling 242, such as via a threaded connection. Other components of the actuator 240—including electromagnetic components, springs, etc. —are not discussed here as they are not important to the design of the presently disclosed rotary diaphragm.

The actuator 240 also has a lower coupling 244 that moves up and down when the actuator 240 is actuated. The lower coupling 244 allows for a mechanical connection to an external lever which can be used by a line worker to manually open the contacts in the switch assembly 200. In prior art VI switch designs, the lower coupling 244 is connected to a translational rod, which is in turn connected to the external lever. However, the vertically-oriented translational rod increases the height of the VI switch, which is undesirable for underground or pad-mounted applications.

The VI switch assembly 200 of the present disclosure is designed to overcome the disadvantages of prior art VI switches. The VI switch assembly 200 includes a rotating insulating rod 250 mechanically coupled to the lower coupling 244 of the actuator 240 by a link 260. A lever 270 external to the housing 210 is attached to the insulating rod 250. When a line worker rotates the lever 270, the link 260 pulls down the lower coupling 244, which pulls down the movable contact 222 and opens the switch. The combination of rotary motion and a short insulating rod length, which is made possible by an insulating rotary diaphragm, provide for a size and shape of the VI switch assembly 200 which is more compact than previously available designs. Details of these components are discussed below.

The voltage isolation characteristics of the VI switch assembly 200 are as follows. The contacts 220/222 are at medium voltage (several thousand volts above ground potential), and there is no insulating component between the contact 222 and the actuator 240; thus, the actuator 240 is also at medium voltage. The link 260, mechanically coupled to the lower coupling 244 of the actuator 240, is therefore also at medium voltage. The insulating rod 250, made of a material such as fiberglass with very low electrical conductivity, provides isolation between the link 260 at medium voltage and the lever 270 which is grounded. An insulating rotary diaphragm 300, discussed in detail below, provides isolation of any airborne or spatial path between the medium voltage components (the actuator 240 and the link 260) and the lever 270 and a plate 280 which are grounded.

The insulating rod 250 includes a disc-shaped flange 252 in a vertical plane underneath the actuator 240. The flange 252 has a pin 254 attached at a radius from the centerline of the rod 250 and generally in a horizontally eccentric position from the centerline of the rod 250. The pin 254 moves within a slot 262 in a lower end of the link 260. At the upper end of the link 260, a through-pin 264 is pivotally coupled to the lower coupling 244 of the actuator 240.

The alignment of the centerline of the insulating rod 250 is maintained by a centering feature 212 in the housing 210 and by a through-hole in the plate 280. One end of the rod 250 pivots in the centering feature 212, and at the other end, the rod 250 passes through O-rings 282 fitted in grooves in the through-hole in the plate 280. The plate 280 seals the opening in the housing 210, as is apparent particularly in FIG. 3. The handle 270 and the plate 280 are preferably made of metal, such as aluminum or stainless steel. The handle 270 and the plate 280 must be positively grounded for the safety of line workers.

Another design feature which ensures that the handle 270 remains positively grounded is to construct the rod 250 with a metal end 256 proximal the handle 270. That is, the portion of the rod 250 which is internal to the housing 210 (from the centering feature 212 to and through the diaphragm 300) is comprised of an insulating material such as fiberglass, while the metal end 256 (the portion of the rod 250 external to the housing 210, including the part that passes through the plate 280) is comprised of a conductive material such as a metal. The metal end 256 is rigidly joined or coupled to the insulating portion of the rod 250 in any suitable fashion—including mating mechanical features of the two components which fit together cooperatively, pins or other fasteners inserted into both components, adhesive, or a combination thereof. When the handle 270 is rotated, the entire rod 250—including the metal end 256—rotates with the handle 270.

The metal end 256 provides a conductive path from the handle 270 to the plate 280 and thereby to ground. The metal end 256 is rigidly connected to the handle 270 in a manner that also provides a reliable conductive path—such as two or more machine screws driven through holes in the handle 270 into threaded holes in the metal end 256. The metal end 256 has a reliable conductive path to the plate 280 which is preferably provided in two ways. First, at least one of the two O-rings 282, and preferably the one towards the inner volume of the housing 210, is a conductive O-ring made in silicone rubber, EPDM rubber, or other suitable elastomer that can be formulated for electrical conductivity. Alternately, the inner O-ring 282 can be replaced with a metallic coil spring made in stainless steel with or without plating (such as chrome, nickel, or silver). In addition, the clearance between the metal end 256 and the inside of the hole in the plate 280 is very small, and can be sized so that any voltage at or above 50V jumps this gap, providing another conductive path from the metal end 256 to the plate 280.

Figure 4:
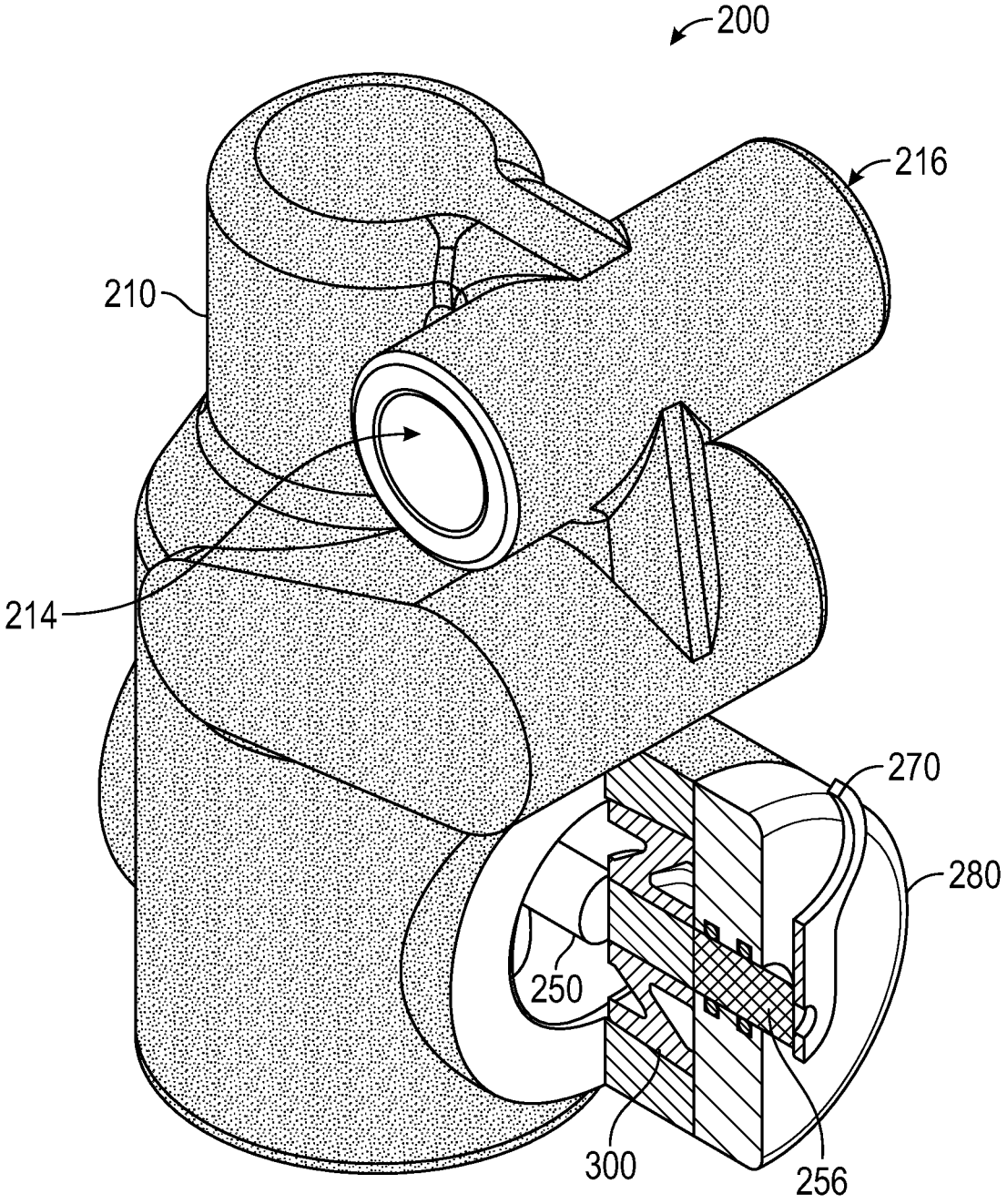
FIG. 4 is an isometric view illustration of the VI switch assembly of FIGS. 2-3 including the entire outer housing, with a cutaway portion showing the rotary diaphragm and the insulating rod, according to an embodiment of the present disclosure.

The plate 280 is itself made of metal and is firmly in contact with the housing 210 as seen in FIGS. 2-4. Because the housing 210 has a conductive coating and is grounded, the plate 280 is therefore grounded. A ground wire may also be provided directly from the plate 280 to the ground where the switch 200 is installed.

The arrangement of the metal end 256, discussed above, ensures that the handle 270 is positively grounded via a conductive path to the plate 280 and in turn to the conductive exterior of the housing 210 and to ground. This provides a reliable grounding of the handle 270 and fail-safe protection for line workers, even in the event that a conductive path is somehow created through the fiberglass portion of the insulating rod 250 to the actuator 240.

The insulating rotary diaphragm 300 fits in an opening cavity in the housing 210, at the right of FIGS. 2 and 3. The inner diameter of the diaphragm 300 is preferably bonded to the outer diameter of the insulating rod 250 to prevent any slipping. The outer diameter of the diaphragm 300 is also bonded to the inside of the opening cavity in the housing 210. Thus, the outer diameter of the diaphragm 300 is fixed to the housing 210 and does not move. When the lever 270 and the insulating rod 250 are rotated, the inner diameter of the diaphragm 300 rotates with them, and the body of the diaphragm 300 therefore deflects in a torsional manner. This is discussed further below.

As mentioned earlier, the lever 270 is provided to allow a line worker to manually open the contacts 220/222 in the VI switch assembly 200. However, in normal fault isolation and service restoration operations, the VI switch assembly 200 is designed to open and reclose the contacts 220/222 by way of the actuator 240. The VI switch assembly 200 is designed so that, when the actuator 240 opens and recloses the contacts 220/222, the lever 270 and the insulating rod 250 do not rotate. This is made possible by the slot 262 in the link 260. That is, the link 260 translates down when the actuator 240 opens the contact 222, and the link 260 translates back up when the actuator 240 recloses the contact 222, but these motions of the link 260 simply cause the slot 262 to move along the pin 254, without moving the pin 254 or rotating the flange 252.

On the other hand, when the line worker wants to manually open the contacts 220/222 in the VI switch assembly 200, the worker turns the lever 270 (counter-clockwise in FIG. 3). This rotation causes the flange 252 to rotate and the pin 254 to move downward. The pin 254 presently contacts the lower end of the slot 262, at which point further rotation of the lever 270 pulls the link 260 downward, which in turn pulls the contact 222 downward and opens the switch. As mentioned earlier, the fully-opened distance between the contacts 220 and 222 is about six mm in the present design embodiment. With the design shown in FIGS. 2 and 3, a lever rotation of about 20-30° is sufficient to cause downward motion of the link 260 which fully opens the contacts 220/222.

The VI switch assembly 200 of FIGS. 2-3 offers several advantages over prior VI switch designs. Specifically, the manual opening mechanism—comprising the insulating rod 250 and the lever 270 configured for rotational motion, the link 260 connecting the pin 254 to the bottom of the actuator 240, and the insulating rotary diaphragm 300—combine to enable VI switch compactness not previously available. The rotational motion avoids extending the switch height, while the diaphragm 300 allows the rod 250 to have a length of only about four inches from the flange 252 to the plate 280, thus adding negligibly to the switch width.

FIG. 4 is an isometric view illustration of the VI switch assembly 200 of FIGS. 2-3 including the entire outer housing 210, with a cutaway portion showing the rotary diaphragm 300 and the insulating rod 250, according to an embodiment of the present disclosure. FIG. 4 simply shows what the entire switch assembly 200 looks like from the outside, whether located in a pit or tunnel underground, or mounted inside a utility box on a pad at ground level.

The outer surface of the housing 210 of the switch assembly 200 is coated with a conductive material and is grounded, as mentioned earlier. The lever 270 and the plate 280 (along with the metal end 256 of the rod 250) are also at ground potential, as discussed above. Openings 214 and 216 (opposite side—not visible) near the top of the housing 210 allow for feed of input and output electrical cables into the housing 210. Passages inside the housing 210 enable the input cable to be electrically coupled to the fixed contact 220, and the output cable to be electrically coupled to the moving contact 222. Sealing devices are used around the input and output cables and the openings 214 and 216, so that the VI switch assembly 200 is weatherproof.

The cutaway portion at the lower right of FIG. 4 shows the arrangement of the lever 270 coupled to the insulating rod 250, which passes through the diaphragm 300. As discussed above, when the lever 270 is rotated by a utility line worker, the diaphragm 300 deforms torsionally while maintaining full contact with the rod 250 and the opening cavity of the housing 210, thereby providing positive isolation to prevent any possible leakage path from the medium voltage components to the plate 280 or the lever 270.

Figure 5A:
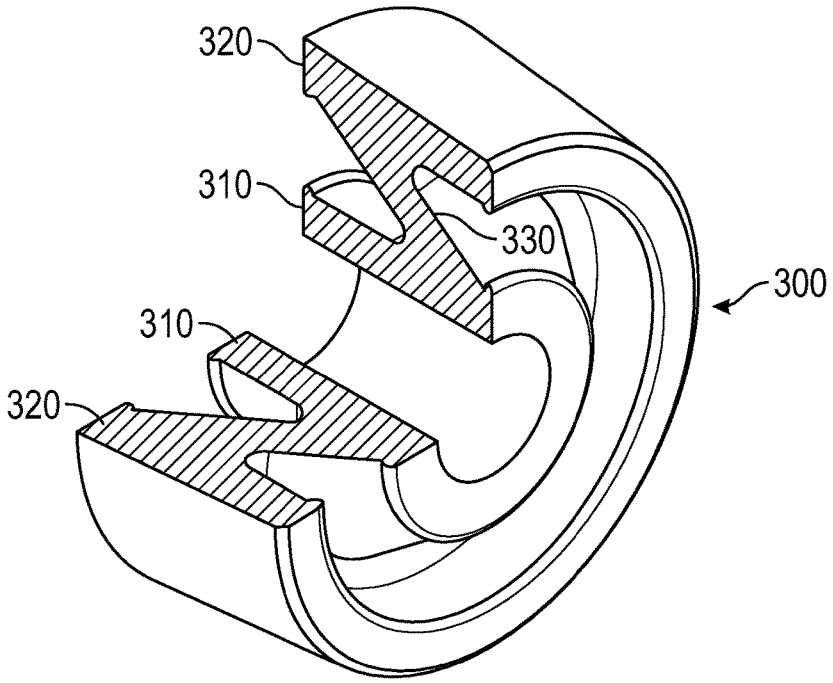
FIGS. 5A and 5B are a cutaway isometric view and a cross-sectional illustration of the insulating rotary diaphragm shown in FIGS. 2-3, according to an embodiment of the present disclosure.
Figure 5B:
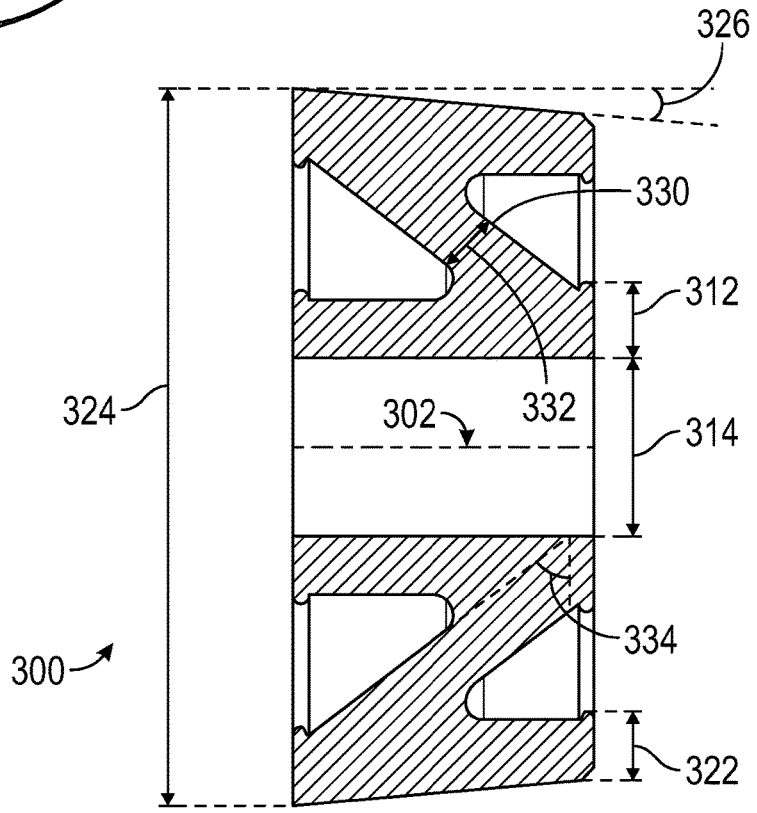

FIGS. 5A and 5B are a cutaway isometric view and a cross-sectional illustration of the insulating rotary diaphragm 300 shown in FIGS. 2-3, according to an embodiment of the present disclosure. The insulating rotary diaphragm 300 has the same design as shown in FIGS. 2-3, which represent a preferred design embodiment. Other design embodiments have been considered, as discussed in later figures, and may be suitable for some applications.

The diaphragm 300 is a one-piece part molded from a compliant material having good electrical insulation properties (such as a resistivity of $10^{10}$ ohm-meters or greater, although certain applications may be employ lower levels of resistivity). Candidate materials include silicone rubber, Ethylene Propylene Rubber (EPR) and Ethylene Propylene Diene Monomer (EPDM). Other materials may also be suitable.

The diaphragm 300 has a centerline 302 and a central hub 310. The central hub 310 is generally cylindrical about the centerline 302, and has a hub wall thickness 312 and an inner diameter 314. The inner diameter 314 matches the diameter of the insulating rod 250, and the inner diameter 314 of the diaphragm 300 is glued or bonded to the insulating rod 250 as discussed earlier.

The diaphragm 300 has an outer wall 320. The outer wall 320 is also generally cylindrical and has an outer wall thickness 322 and an outer diameter 324. In the preferred embodiment, the outer wall 320 has a taper angle 326, such that the outer diameter 324 exists at one end of the diaphragm 300 (the end which is proximal the plate 280 when installed in the housing 210), and an outer diameter at the other end of the diaphragm 300 is slightly smaller. The outer wall thickness 322 may also taper from one end of the diaphragm 300 to the other. The taper angle 326 allows for a positive placement and fit of the diaphragm 300 into the opening cavity of the housing 210. The outer surface of the diaphragm 300 is glued or bonded to the inner wall of the opening cavity of the housing 210, as discussed earlier.

Connecting the central hub 310 to the outer wall 320 is a web 330. The web 330 has a web thickness 332, and a web orientation angle 334 relative to a normal to the centerline 302. In the preferred design embodiment, the web 330 is axisymmetric—meaning that the web 330 does not have any helical pitch (like a screw thread). That is, any radial cross-section of the diaphragm 300 will appear the same, regardless of what circumferential location it is taken. Various filets and radii are applied to the intersections of the web 330 with the central hub 310 and the outer wall 320, resulting in localized thicknesses greater than the nominal value of the web thickness 332.

The design of the diaphragm 300 shown in FIGS. 5A and 5B has been structurally analyzed and found to provide good torsional stiffness properties, and maximum stresses in a suitable range when torsionally deflected in the manner discussed above with respect to FIGS. 2-4.

Figure 6A:
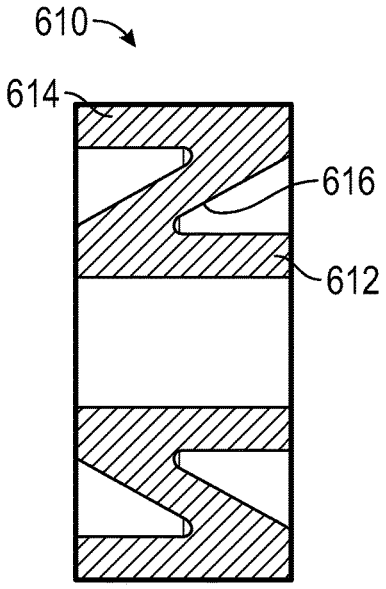
FIGS. 6A through 6E are cross-sectional illustrations of different geometric designs of the insulating rotary diaphragm, according to embodiments of the present disclosure.

FIGS. 6A through 6E are cross-sectional illustrations of different geometric designs of the insulating rotary diaphragm, according to embodiments of the present disclosure. A diaphragm 610 in FIG. 6A is very similar to the diaphragm 300 discussed above, having a central hub 612 and an outer wall 614 connected by a web 616 which is axisymmetric (has no helical pitch). The diaphragm 610 shown in FIG. 6A does not include a taper, but is otherwise similar to the diaphragm 300. In fact, the rotary diaphragms in all of FIGS. 6A through 6E lack any taper; these designs were created and analyzed to determine their stress and torsional stiffness characteristics. Because of its advantageous characteristics, the diaphragm 610 was chosen for further development, and the taper was added, resulting in the design of the rotary diaphragm 300.

Figure 6B:
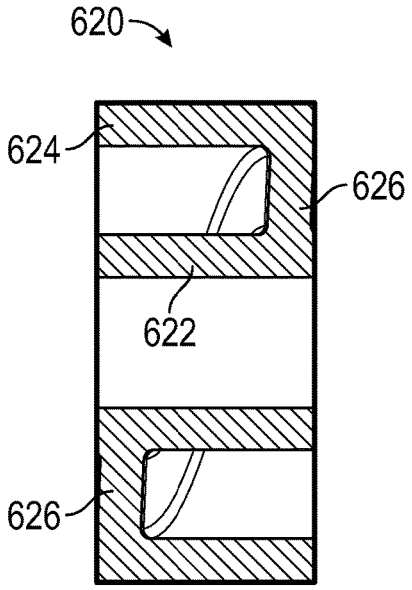

A diaphragm 620 in FIG. 6B has a central hub 622 and an outer wall 624 connected by a web 626. The web 626 has an orientation angle of 0°, meaning that the cross-section of the web 626 is normal to the centerline of the diaphragm 620. However, the web 626 has a helical pitch angle which causes the web 626 to be located at one end of the diaphragm 620 at one circumferential position and located at the other end of the diaphragm 620 at a 180° opposite circumferential position.

Figure 6C:
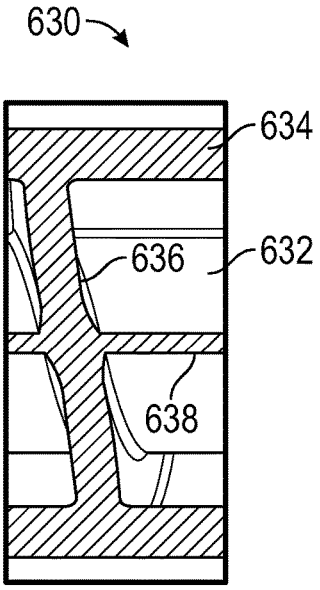

A diaphragm 630 in FIG. 6C has a central hub 632 and an outer wall 634 connected by a web 636. The central hub 632 is shown in total, not in cross-section, because the section is not taken on a diameter. The section of the view is taken outside the hub 632 so as to make visible a longitudinal or axial web 638 which connects the hub 632 to the outer wall 634. A plurality of the axial webs 638 (such as two, four or eight) would be located at equally-spaced circumferential positions around the diaphragm 630. The web 636 has both a non-zero orientation angle and a shallow helical pitch angle which continues beyond 180° of circumferential position.

Figure 6D:
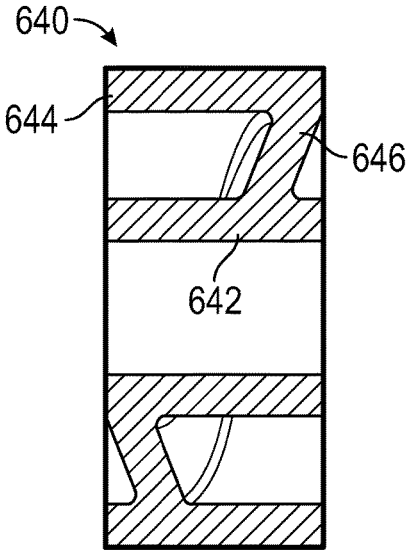

A diaphragm 640 in FIG. 6D has a central hub 642 and an outer wall 644 connected by a web 646. The web 646 has a non-zero orientation angle, and a helical pitch angle similar to the diaphragm 620 of FIG. 6B.

Figure 6E:
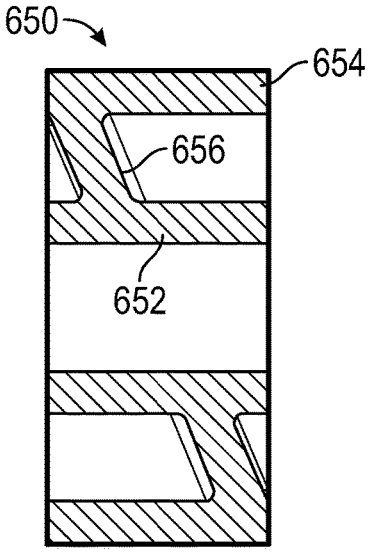

A diaphragm 650 in FIG. 6E has a central hub 652 and an outer wall 654 connected by a web 656. The web 656 has a non-zero orientation angle similar to the diaphragm 640 of FIG. 6D. However, rather than a helical shape, the web 656 has a simple flat plate shape arranged at an angle relative to the normal to the centerline.

As can be seen in FIGS. 6A through 6E, a variety of rotary diaphragm shapes and design configurations have been evaluated—including various combinations of web angles and shapes, in both axisymmetric and non-axisymmetric configurations. Each diaphragm design which was analyzed yielded stress and torsional stiffness characteristics which ultimately influenced the final design shown in FIGS. 5A and 5B. Other designs—including those shown in FIGS. 6A through 6E and otherwise, may be suitable for other VI switch applications.

Figure 7:
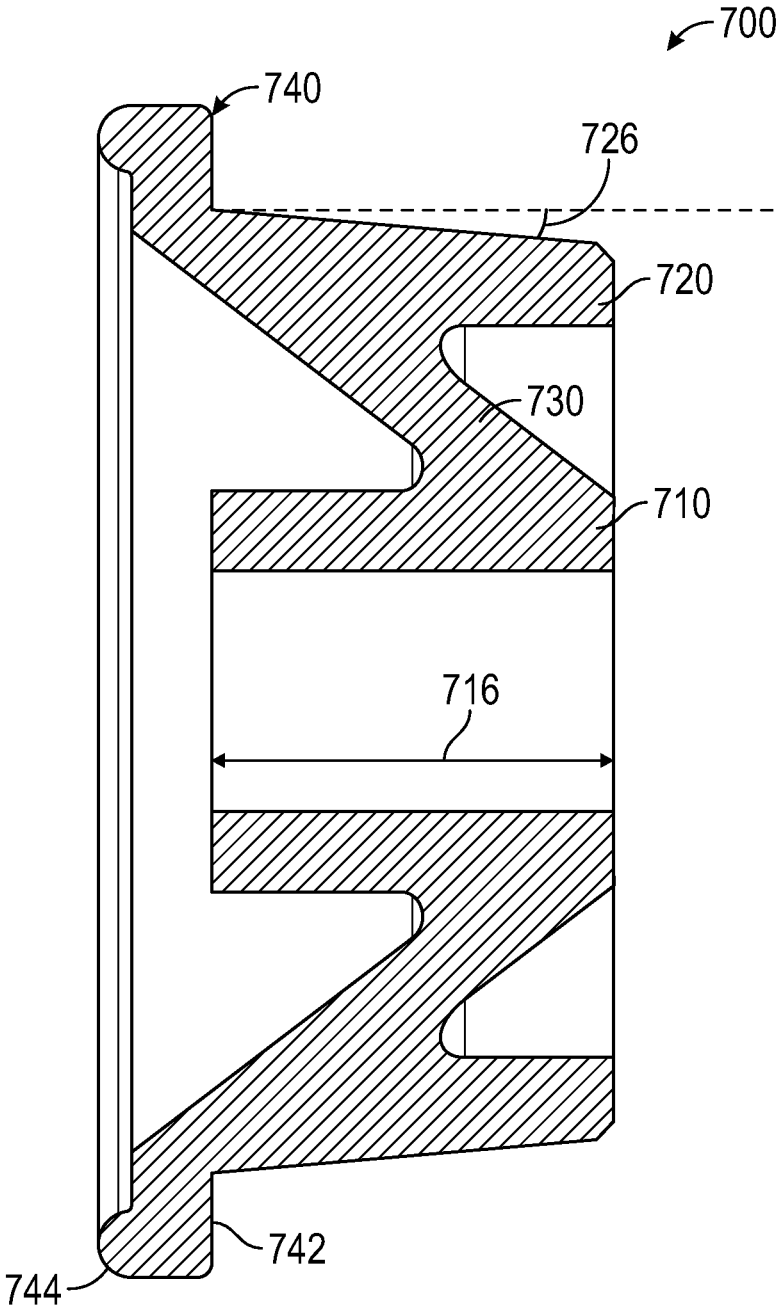
FIG. 7 is a cross-sectional illustration of another design of the insulating rotary diaphragm, having a peripheral lip on one end, according to an embodiment of the present disclosure.

FIG. 7 is a cross-sectional illustration of another design of the insulating rotary diaphragm, having a peripheral lip on one end, according to an embodiment of the present disclosure. A diaphragm 700 is generally similar in design and shape to the diaphragm 300 of FIGS. 5A and 5B. The diaphragm 700 includes a central hub 710 and an outer wall 720 connected by a web 730 which is axisymmetric. The outer wall 720 has a taper angle 726, as seen earlier on the diaphragm 300.

The diaphragm 700 includes a lip 740 which extends circumferentially around the periphery of the outer wall 720 at the larger diameter end of the diaphragm 700. When installed in the housing 210, a face 742 of the lip 740 presses against an end face of the opening of the housing 210, while an opposing rounded surface 744 is compressed in a groove which would be provided in a face of the centering plate 280. These features of the lop 740 offer another means of securely fixing the outer diameter of the diaphragm 700 to the housing 210, while also providing additional blockage of any potential voltage leakage path from the medium voltage switch components to the plate 280.

The central hub 710 has a length 716 which extends only to the plane of the face 742, in order to facilitate the fit of the diaphragm 700 under the plate 280.

As will be understood by those skilled in the art, the controller described above in the VI switch assembly 200 performs various calculations and process steps associated with the opening and reclosing of the VI switch assembly 200. These calculations and process steps may be referring to operations performed by a computer, a processor or other electronic calculating device that manipulate and/or transform data using electrical phenomenon. Those processors and electronic devices may employ various volatile and/or non-volatile memories including non-transitory computer-readable medium with an executable program stored thereon including various code or executable instructions able to be performed by the computer or processor, where the memory and/or computer-readable medium may include all forms and types of memory and other computer-readable media.

The disclosed insulating rotary diaphragm and the corresponding insulating rod and mechanism for a vacuum interrupter (VI) electrical switch provide a significant advantage over prior designs in terms of compactness of the overall switch assembly. This compactness is particularly desirable in underground and pad-mounted VI switch applications.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. A manual opening mechanism for a vacuum interrupter (VI) switch, the mechanism comprising:

a torsional insulating rod pivotally mounted in a housing of the VI switch, the insulating rod passing through a plate that covers an opening in the housing;

a link coupling an eccentric pin on the insulating rod to a stem in a switch actuator;

a lever fixed to the insulating rod external to the housing; and an insulating diaphragm bonded to an interior surface of the housing and bonded to an outer surface of the insulating rod, the diaphragm electrically isolating the plate and the lever from the actuator by physically blocking any spatial path from the actuator to the plate within the housing, where a manual rotation of the lever rotates the insulating rod, and the eccentric pin on the insulating rod displaces the link causing a translational motion of the stem in the switch actuator that opens contacts in the VI switch.

2. The mechanism according to claim 1 wherein the manual rotation of the lever causes a torsional elastic deformation of the diaphragm.

3. The mechanism according to claim 1 wherein the diaphragm is constructed in a single piece of a material having an electrical resistivity greater than a prescribed resistivity value and an elastic modulus less than a prescribed modulus value.

4. The mechanism according to claim 3 wherein the material is silicone rubber, Ethylene Propylene Rubber (EPR) or Ethylene Propylene Diene Monomer (EPDM).

5. The mechanism according to claim 1 wherein the diaphragm comprises a cylindrical inner hub and an outer wall connected by a continuous circumferential web, where the diaphragm has a cross-sectional shape that is the same at all circumferential positions of the diaphragm.

6. The mechanism according to claim 1 wherein the link includes a slot within which the eccentric pin on the insulating rod moves.

7. The mechanism according to claim 6 wherein, when the switch actuator opens or recloses the contacts in the VI switch, the slot in the link moves relative to the eccentric pin without causing rotation of the insulating rod.

8. The mechanism according to claim 6 wherein an initial manual rotation of the lever causes the eccentric pin to move to an end of the slot, and a further manual rotation of the lever causes the link to move the stem in the switch actuator and open the contacts in the VI switch.

9. The mechanism according to claim 8 wherein the eccentric pin and the link are configured such that the contacts in the VI switch are fully opened by a total manual rotation of the lever of less than 30 degrees.

10. The mechanism according to claim 1 wherein the switch actuator is at a voltage potential of the contacts in the VI switch, and the lever and the plate are grounded.

11. The mechanism according to claim 1 wherein the torsional insulating rod includes an insulating portion fixedly coupled to a metal end, where insulating portion extends from the eccentric pin to and through the insulating diaphragm, the metal end passes through the plate and is mechanically and electrically coupled to the lever, and the metal end maintains electrical contact with the cover via at least one conductive slip fitting including a conductive O-ring, a conductive bushing or a metal coil spring.

12. An insulating diaphragm for a vacuum interrupter (VI) switch, the diaphragm comprising a cylindrical inner hub and an outer wall connected by a continuous circumferential web, where the inner hub is bonded to an insulating rod in the VI switch and the outer wall is bonded to an inner surface of a switch housing such that the diaphragm electrically isolates components on one end of the insulating rod from components on the other end of the insulating rod, and a rotation of the insulating rod causes a torsional elastic deformation of the diaphragm, and where the diaphragm is constructed in a single piece of a material having an electrical resistivity greater than a prescribed resistivity value and an elastic modulus less than a prescribed modulus value.

13. The insulating diaphragm according to claim 12 wherein the material is silicone rubber, Ethylene Propylene Rubber (EPR) or Ethylene Propylene Diene Monomer (EPDM).

14. The insulating diaphragm according to claim 12 wherein the diaphragm has a cross-sectional shape that is the same at all circumferential positions of the diaphragm.

15. The insulating diaphragm according to claim 12 wherein an outer surface of the outer wall has a taper angle matching a taper angle of the interior surface of the switch housing to which the outer wall is bonded.

16. The insulating diaphragm according to claim 12 wherein the diaphragm further includes a peripheral lip on one end, where the lip is shaped to fit in a groove in a plate that covers the opening in the switch housing.

17. A vacuum interrupter (VI) switch assembly comprising:

a housing;

a pair of switch contacts located in a vacuum volume inside the housing, including a fixed contact and a moving contact;

an actuator inside the housing with a stem coupled to the moving contact;

a controller configured to, upon detection of a fault current, signal the actuator to open the switch contacts;

a torsional insulating rod pivotally mounted in the housing, the insulating rod passing through a plate that covers an opening in the housing;

a link coupling an eccentric pin on the insulating rod to the stem in the actuator;

a lever fixed to the insulating rod external to the housing; and an insulating diaphragm bonded to an interior surface of the housing and bonded to an outer surface of the insulating rod, the diaphragm electrically isolating the plate and the lever from the actuator by physically blocking any spatial path from the actuator to the plate within the housing, where a manual rotation of the lever rotates the insulating rod, and the eccentric pin on the insulating rod displaces the link causing a translational motion of the stem in the actuator that opens the contacts.

18. The switch assembly according to claim 17 wherein the diaphragm comprises a cylindrical inner hub and an outer wall connected by a continuous circumferential web, where the diaphragm has an axisymmetric shape, and where the diaphragm is constructed in a single piece of silicone rubber, Ethylene Propylene Rubber (EPR) or Ethylene Propylene Diene Monomer (EPDM).

19. The switch assembly according to claim 17 wherein the link includes a slot within which the eccentric pin on the insulating rod moves.

20. The switch assembly according to claim 19 wherein, when the actuator opens or recloses the switch contacts, the slot in the link moves relative to the eccentric pin without causing rotation of the insulating rod.

21. The switch assembly according to claim 19 wherein an initial manual rotation of the lever causes the eccentric pin to move to an end of the slot, and a further manual rotation of the lever causes the link to move the stem in the actuator and open the switch contacts.

* * * * *